US005694999A

United States Patent [19]

Lee et al.

[11] Patent Number: 5,694,999

[45] Date of Patent: Dec. 9, 1997

[54] METHOD OF MAKING A SOCKET PLATE

[75] Inventors: Hanjung Lee; Hanhung Lee, both of Seoul, Rep. of Korea

[73] Assignee: Sung Young Metal Works Co., Ltd., Kyoug Ki Do, Rep. of Korea

[21] Appl. No.: 562,552

[22] Filed: Nov. 24, 1995

[30] Foreign Application Priority Data

Oct. 6, 1995 [KR] Rep. of Korea ..... 95-39893

[51] Int. Cl.[6] ..... B22D 18/02; B22D 19/00

[52] U.S. Cl. ..... 164/98; 164/112; 164/120

[58] Field of Search ..... 164/97, 98, 120, 164/112

[56] References Cited

U.S. PATENT DOCUMENTS

| | | | |
|---|---|---|---|
| 1,347,728 | 7/1920 | Wills | 164/120 |
| 1,939,982 | 12/1933 | Johnson | 164/98 |
| 2,639,952 | 5/1953 | Whiteley | 164/98 X |
| 2,890,915 | 6/1959 | Benham | 164/98 X |
| 4,712,600 | 12/1987 | Hamajima et al. | 164/97 |

FOREIGN PATENT DOCUMENTS

| | | | |
|---|---|---|---|
| 60-244456 | 12/1985 | Japan | 164/97 |
| 62-81259 | 4/1987 | Japan | 164/98 |
| 1-254366 | 10/1989 | Japan | 164/97 |
| 2-112849 | 4/1990 | Japan | 164/97 |

*Primary Examiner*—J. Reed Batten, Jr.
*Attorney, Agent, or Firm*—Longacre & White

[57] ABSTRACT

An inner bearing is disposed in a cast mold formed by a punch and a die. A molten metal is poured into the die. Pressure is then applied to the molten metal. The socket plate is then knocked out by means of a pin member which passes into the mold to dislodge the socket plate.

2 Claims, 3 Drawing Sheets

METHOD OF MAKING A SOCKET PLATE

BACKGROUND OF THE INVENTION a) Field of the Invention

The present invention relates to a method for making a socket plate of a wobble-type compressor for an automotive air conditioning system and, more particularly, to a method for making a socket plate which can improve a productivity of the socket and reduce the time for making the socket plate.

b) Description of the Related Art

Like the general air conditioning system, the automotive air conditioning system consists of a compressor, a condenser, an expansion valve and an evaporator.

The compressor pumps the refrigerant through the refrigeration system. It draws the refrigerant vapor from the evaporator, compresses it and discharges it to the condenser.

There are several types of compressors, all serving the same purpose. Some of these are the wobble type, swash type, and rotary type.

The present invention concerns wobble type compressor which will be described hereinafter.

FIG. 3 shows the wobble type compressor having a socket plate. The compressor comprises a cylinder 32, a piston 33, a connecting rod 34, a socket plate 40, and a rotary shaft 36.

The socket plate 40 is mounted on the rotary shaft 36 and inclined at a predetermined angle. The connecting rod 34 is swivelly rotatably mounted on the socket plate 40. The piston 33 is connected to the connecting rod 34 and movably inserted in the cylinder. Accordingly, as the rotary shaft rotates, the socket plate rotates therewith to move the connecting rod in a vertical direction by the inclined angle such that the piston reciprocates in the cylinder 32.

Accordingly, the piston compresses by use of the socket plate the refrigerant vapor to increase the pressure and discharge it to the condenser to cause circulation thereof.

The socket plate includes a body on which the connecting rod is mounted and a bearing.

The socket plate generally is fabricated by a forging process. The forging process requires large loads and is a relatively complicated process. However, this process can densely arrange the particles of the socket plate compared with cutting process. In addition, since all particles can be arranged without cutting, the hardness of the product can be improved.

Another conventional method for making the socket plate includes as a pre-process the steps of making a billet by casting molten metal, providing a heat treatment to the billet, forming a predetermined configuration by an extrusion method, and cutting the extruded product to thereby produce an aluminum ingot which is suited to the forging process.

The aluminum ingot is then formed in a socket plate by the forging process in the main-process. This will be described hereinafter in detail.

The main-process can be divided into initial process, intermediate process, and finishing process.

First, each mould for the initial, intermediate and finish processes is designed and manufactured.

In the initial process, the aluminum ingot is disposed in the mould for this initial process and then is pressed to thereby be formed as a pre-socket plate required for the intermediate process.

In the intermediate process, the pre-socket plate is located in the mould for this intermediate process, and then is pressed to be formed in the socket plate without the inner bearing. The socket plate is then trimmed to remove the burr.

In the finishing process, the inner bearing is fitted into an inner hole of the socket plate by use of force such as hydraulic pressure.

The above described method has an advantage of obtaining a socket plate having high strength, but has disadvantages of wasting time and effort because of the complicate process and of increasing manufacturing costs due to the equipment having considerable energy consumption.

SUMMARY OF THE INVENTION

The present invention is made in an effort to solve the above described problems of the conventional art.

It is an object of the present invention to provide a method for making a socket plate of a wobble-type compressor for an automotive air conditioning system which can omit the preliminary process and simplify the main-process, thereby saving production costs and time.

To achieve the above described object, the present invention provides a method for making a wobble-type socket plate, comprising the steps of:

disposing an inner bearing in a cast mould formed by a punch and a die;

pouring a molten metal into the cast mould where the inner bearing is disposed;

applying a press pressure to the molten metal; and knocking out the socket plate by means of a pin member adapted to pass into the cast mould to dislodge the socket plate.

In preference, the inner bearing is provided with a flange on a portion contacting the molten metal and the flange is provided with one or more coupling grooves spaced apart from each other.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DESCRIPTION OF THE PREFERRED EMBODIMENT

FIG. 1A to 1D show respectively first to fourth steps of the inventive method for making a socket plate of a wobble type compressor for an automotive air conditioning system according to a preferred embodiment of the present invention.

The inventive method uses both a casting process and a press process.

Although the method using only the casting process has an advantage of obtaining a product through only one step, the mould forms a cast cavity, a gate, and a runner; however, unwanted blowholes are frequently formed in the product made solely by the casting process.

Further, the method using only the press process can also obtain the product through only one step when using a thin metallic panel. When a thick metallic panel is used, many steps are required during plastic working. However, the product obtained through the plastic working is dense in its particles and is high in its mechanical properties.

The inventive method set forth herein uses the advantages of the two methods. That is, the socket plate is produced by providing a molten metal to a mould and then pressing the molten metal such that the mechanical properties and hardness thereof are enhanced while simplifying the manufacturing process.

Figure 1A:
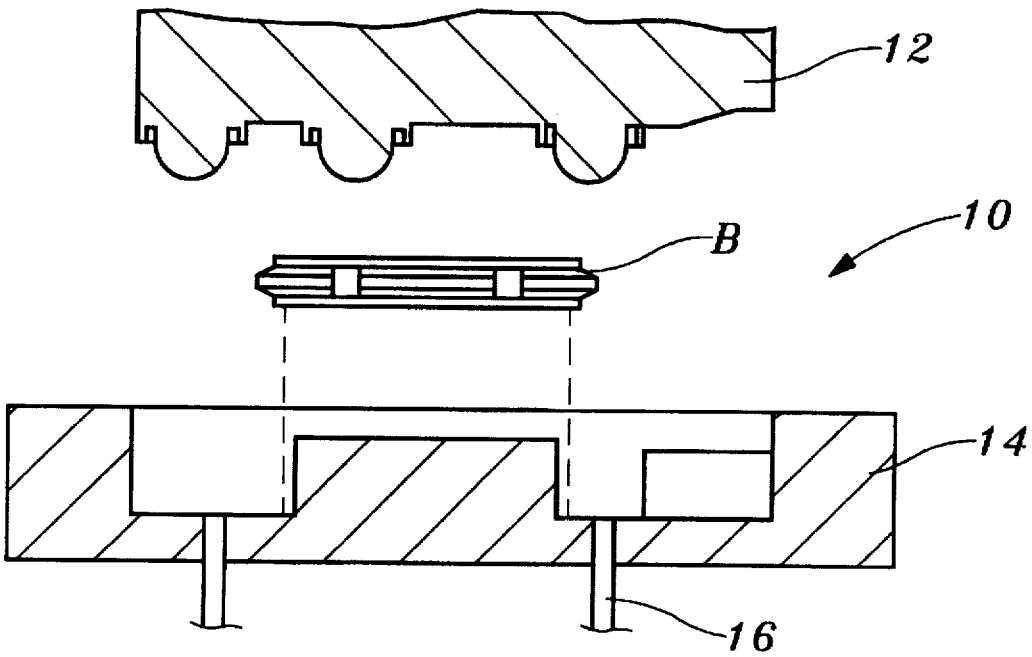
FIG. 1A is a view showing the first step of a method for making a socket plate according to the preferred embodiment of the present invention, where an inner bearing is positioned in a socket plate.

As shown in FIG. 1A, a socket plate mould 10 used in the inventive method includes a punch 12 and a die 14 without a special gate.

The punch 12 is actuated by a press (not shown) and the die 14 supports the socket plate which consists of inner bearing B and molten metal forming the body of the socket plate. The socket plate is pressed by the press pressure through the punch 12. A molten metal is configured to be corresponding to the socket plate between the die 14 and the punch 12. Therefore, a surface of the punch 12 which contacts the molten metal has a configuration corresponding to an upper surface of the socket plate 40 and the die 14 has a groove corresponding to a lower surface of the socket plate 40. An under pin 16 is mounted under the groove.

Since the molten metal contracts while it is solidified, the punch 12 and the die 14 have to be configured after due consideration such that a desired sized socket plate can be obtained.

On the one hand, an inner bearing B is pre-positioned on a portion of the die where a rotary shaft is mounted on the socket plate 40.

Figure 1B:
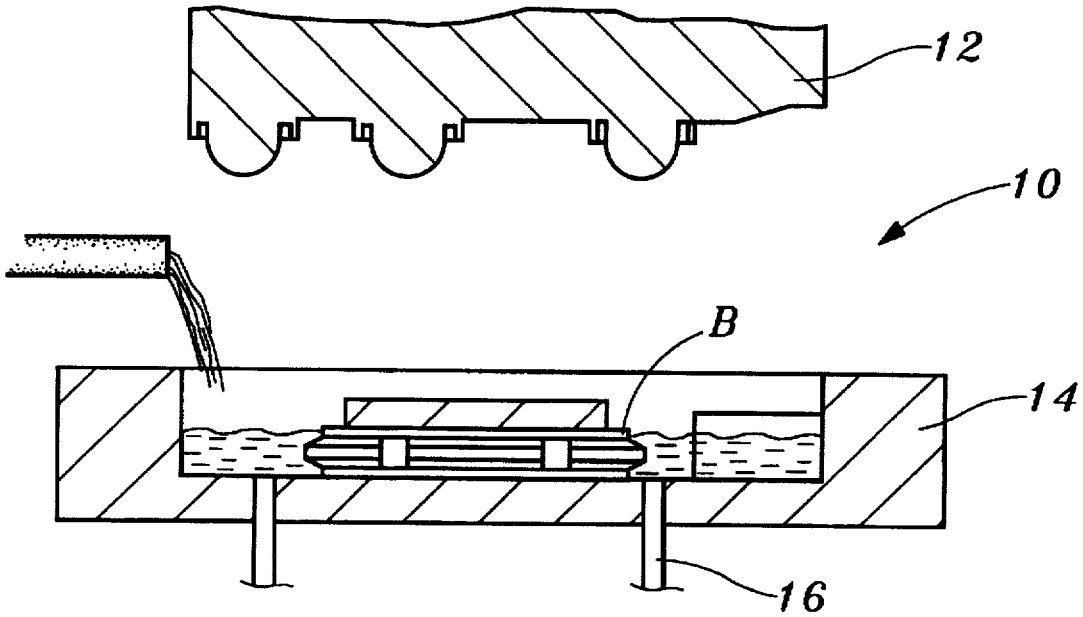
FIG. 1B is a view showing the second step of a method for making a socket plate according to a preferred embodiment of the present invention, where a molten metal is poured into the socket plate mould.

Referring to FIG. 1B showing the second step of the inventive method, the molten metal is poured into the die 14 to have a level corresponding to the height of the inner bearing B in case the height of the inner bearing B is higher than that of a body of socket plate 40. However, in case that the height of the inner bearing B is lower than that of the body of the socket plate 40, means for preventing the molten metal from soaking into the inner bearing is required.

Accordingly, the second step of the present invention does not use the gate which has been used in the conventional casting process so that it becomes easy to pour the molten metal into the die 14.

Figure 1C:
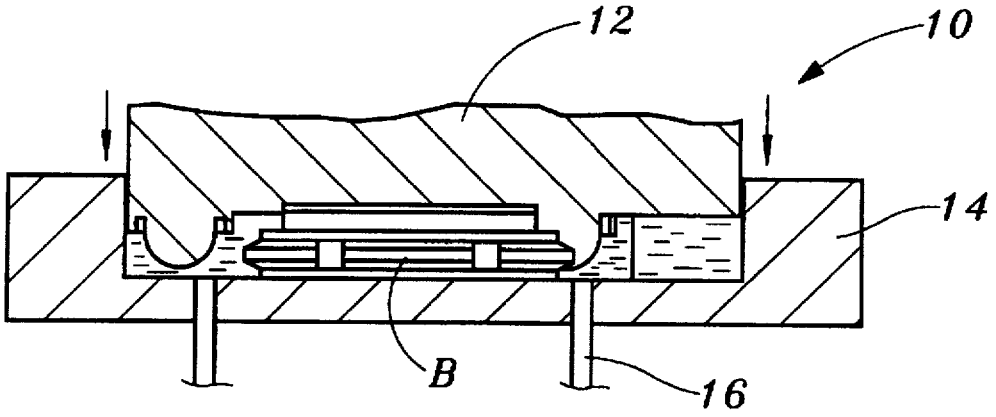
FIG. 1C is a view showing the third step of a method for making a socket plate according to a preferred embodiment of the present invention, where the socket plate mould containing the molten metal is applied with a press pressure.

Referring to FIG. 1C which shows the third step of the inventive method, the punch 14 apply press pressure to the die 14 to which the molten metal has been poured. At this point, the punch 12 has a moving distance which is proper to the size of the socket plate 40. The moving distance is determined by considering the amount of the molten metal and the shrinkage allowance at the time that the molten metal is solidified.

At this process, since the molten metal is solidified while receiving relatively lower press pressure, it is possible to use much lower amount of the press pressure than that of the conventional art.

In addition, grain of the product becomes dense and without bubbles and a precision size can be obtained.

Figure 1D:
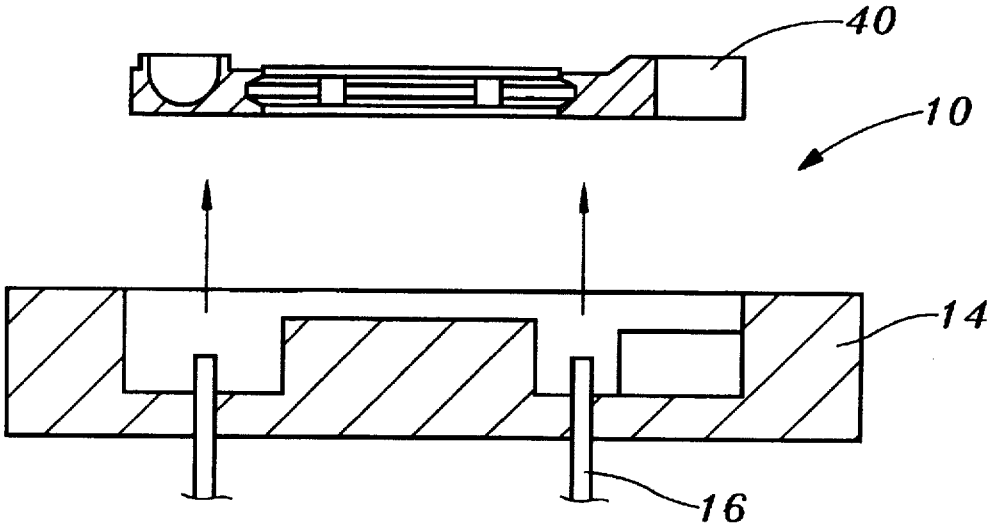
FIG. 1D is a view showing the fourth step of a method for making a socket plate according to a preferred embodiment of the present invention, where a socket plate is knocked out by means of a pin member adapted to pass into the cast mould to dislodge the socket plate.

Referring to FIG. 1D which shows the fourth step of the inventive method, the socket plate 40 formed by solidifying the molten metal is knocked out by the under pin 16. The knocked out socket plate is produced in precision size and does not require finish work since there is no burr as typically produced in the conventional forging or plastic working methods.

As described above, the inner bearing B used in the above described processes is disposed in the die and then coupled with the body of the socket plate by solidifying the molten metal. Accordingly, to firmly couple the inner bearing with the socket plate, the configuration of the inner bearing B should be differently formed from the conventional inner bearing.

Figure 2:
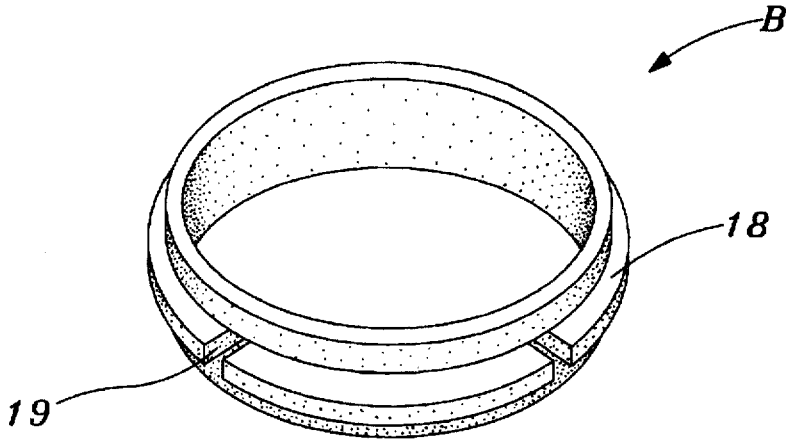
FIG. 2 is a view showing an inner bearing adapted to the present invention.
Figure 3:
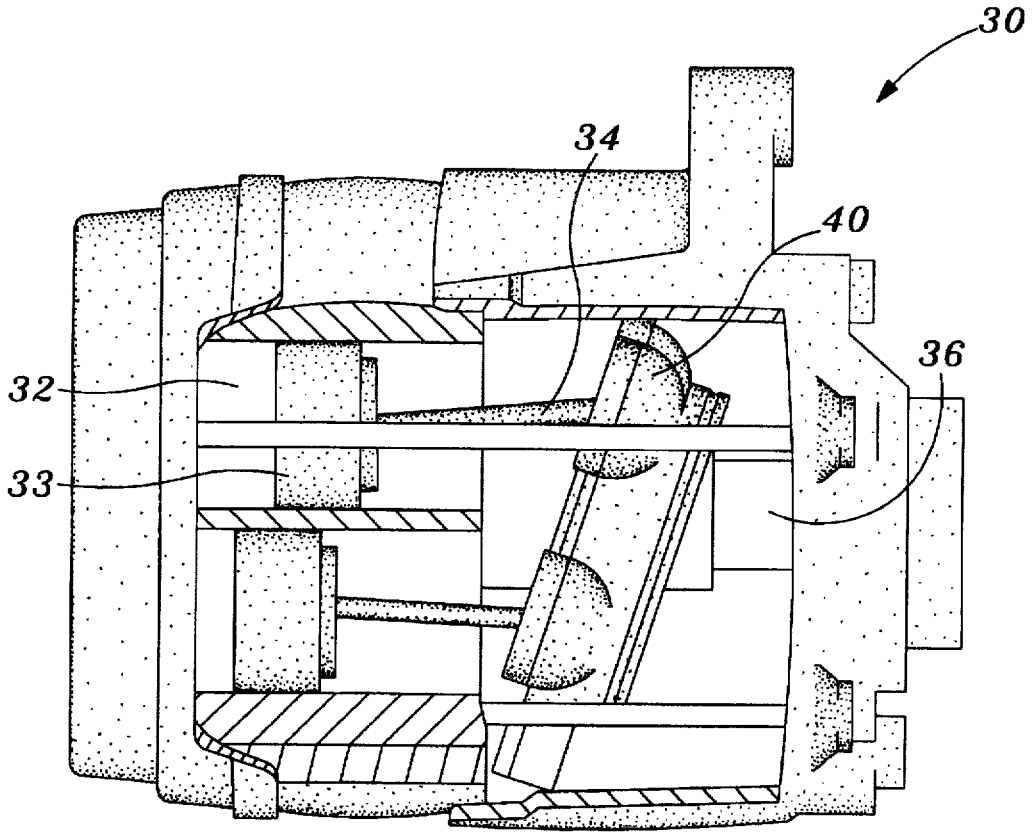
FIG. 3 PRIOR ART
FIG. 3 is a view showing a conventional wobble-type compressor having a socket plate.

FIG. 2 shows the inner bearing of the wobble-type socket plate according to the present invention. The inner bearing is provided with a flange 18 on a portion contacting the molten metal to prevent the inner bearing from vertically displacing by outer force produced while the solidified metal is contracted.

Further, the flange 18 is provided with coupling grooves 19 spaced apart from each other to prevent the inner bearing B from displacing in a circular direction while the solidified metal is also contracted.

It will be apparent to those skilled in the art that various modifications and variations can be made in the method for making the socket plate of the present invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method for making a socket plate, comprising the steps of:

disposing an inner bearing having an aperture in a die, said die including a raised finger portion passing into the aperture of said inner bearing to thereby retain said inner bearing in a stationary position with respect to said die;

pouring a molten metal into the die in order that the molten metal is adjacent to and at least partially circumscribes the inner bearing;

applying a press pressure to the molten metal by means of a punch;

solidifying said molten metal; and knocking out the socket plate by means of a pin member adapted to pass into the die to dislodge the socket plate.

2. The method according to claim 1, wherein the inner bearing is provided with a flange on a portion contacting the molten metal to prevent said bearing from moving in a vertical direction and the flange is provided with one or more coupling grooves spaced apart form each other to prevent the bearing from displacing in a circumferential direction.

* * * * *